US005630477A

United States Patent [19]

Minatre

[11] Patent Number: 5,630,477

[45] Date of Patent: May 20, 1997

[54] DOWNCROWDABLE TELESCOPIC AUGERING APPARATUS

[76] Inventor: William H. Minatre, P.O. Box 546, Benicia, Calif. 94510

[21] Appl. No.: 459,215

[22] Filed: Jun. 2, 1995

[51] Int. Cl.[6] ..... E21C 5/00

[52] U.S. Cl. ..... 173/184; 173/27; 173/39; 173/147; 173/193

[58] Field of Search ..... 173/184, 27, 42, 173/147, 193, 194, 165

[56] References Cited

U.S. PATENT DOCUMENTS

| | | | |
|---|---|---|---|
| 3,690,387 | 9/1972 | Dixon | 173/193 |
| 3,994,350 | 11/1976 | Smith et al. | 173/147 |
| 4,226,447 | 10/1980 | Brown | 173/197 |
| 4,303,130 | 12/1981 | Bonca | 173/27 |
| 4,645,084 | 2/1987 | Deike | 173/194 |
| 4,860,837 | 8/1989 | Robert | 173/165 |
| 4,877,091 | 10/1989 | Howell, Jr. | 173/89 |
| 5,396,964 | 3/1995 | Shellhorn et al. | 173/42 |

*Primary Examiner*—Scott A. Smith
*Attorney, Agent, or Firm*—Schapp and Hatch

[57] ABSTRACT

A downcrowdable telescopic augering apparatus including a vehicle having a boom which carries a cradle in which a kelly tube is slidably mounted and on which a kelly winch and a service winch are mounted. A winch management system oversees the operation of said winches to prevent the kelly cable and the service cable from being broken or becoming slack when the kelly tube moves with respect to the cradle. A bottomhole kelly cable arresting system arrests the rotation of the drum of the kelly winch when the kelly cable is slack.

4 Claims, 11 Drawing Sheets

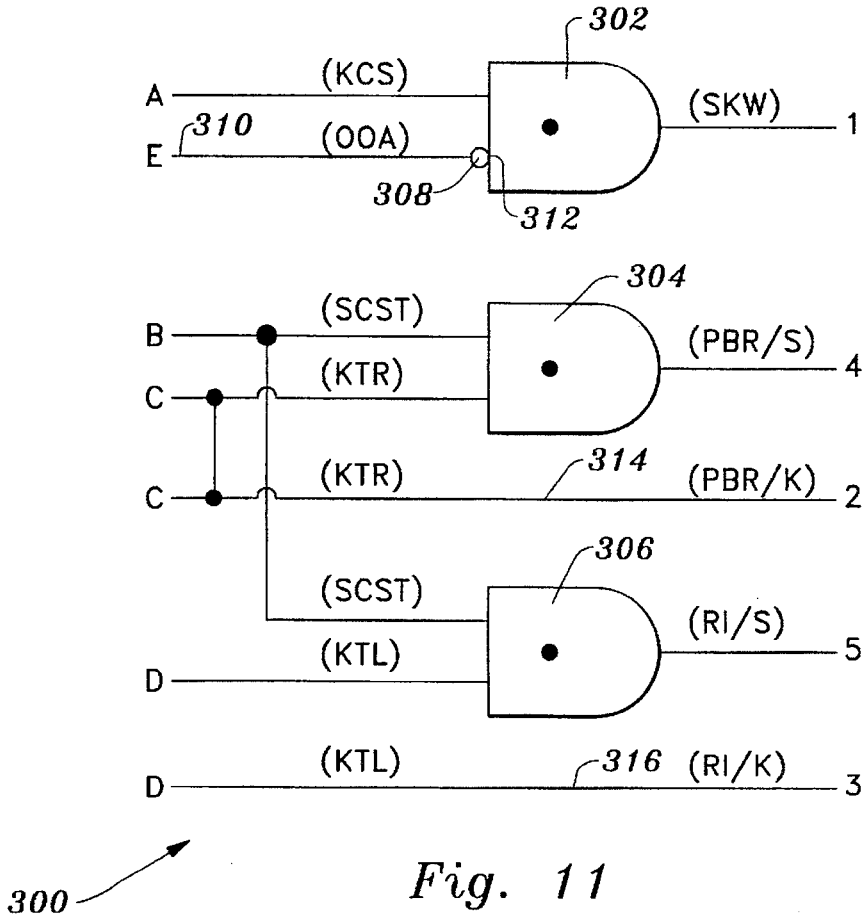

*Fig. 11*

INPUT SIGNALS

A. KELLY CABLE SLACK (KCS).
(SWITCH 77 – FIG. 6).
B. SERVICE CABLE STORED (SCST)
(SWITCH 102 – FIGS. 4)
C. KELLY TUBE BEING RAISED (KTR).
D. KELLY TUBE BEING LOWERED (KTL).
E. OPERATOR OVERRIDE ACTIVE (OOA).
(SWITCH 340 – FIG. 14)

OUTPUT SIGNALS

1. STOP KELLY WINCH (SKW).
2. PARTIALLY RELEASE KELLY WINCH BRAKE (PBR/K).
3. REEL IN KELLY WINCH CABLE (RI/K).
4. PARTIALLY RELEASE SERVICE WINCH BRAKE (PBR/S).
5. REEL IN SERVICE CABLE (RI/S).

*Fig. 12*

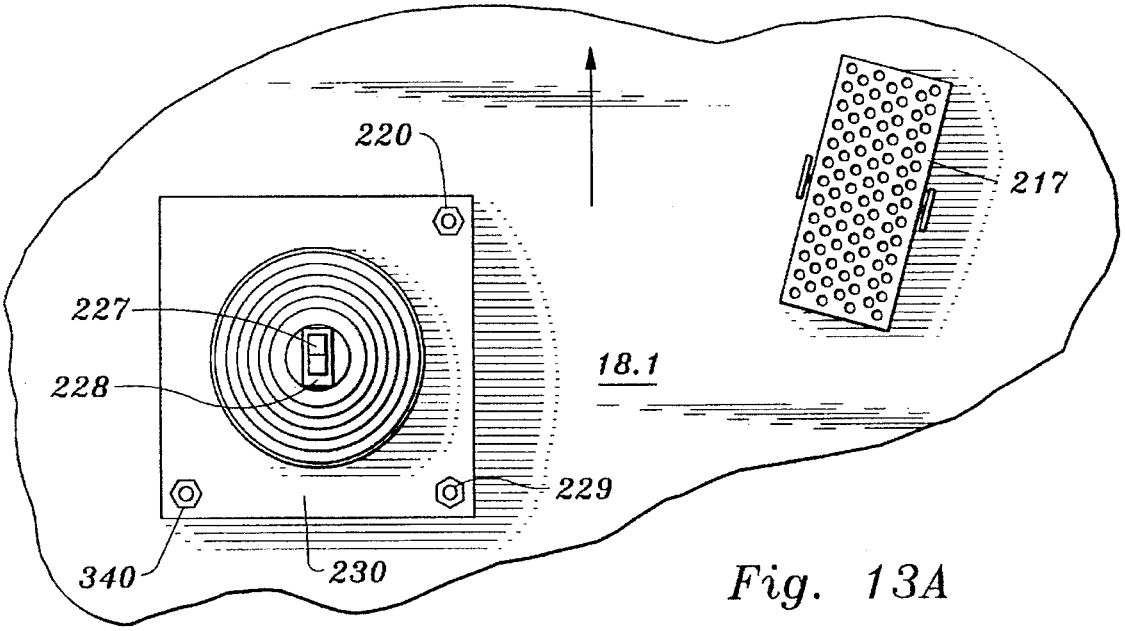
Fig. 13A
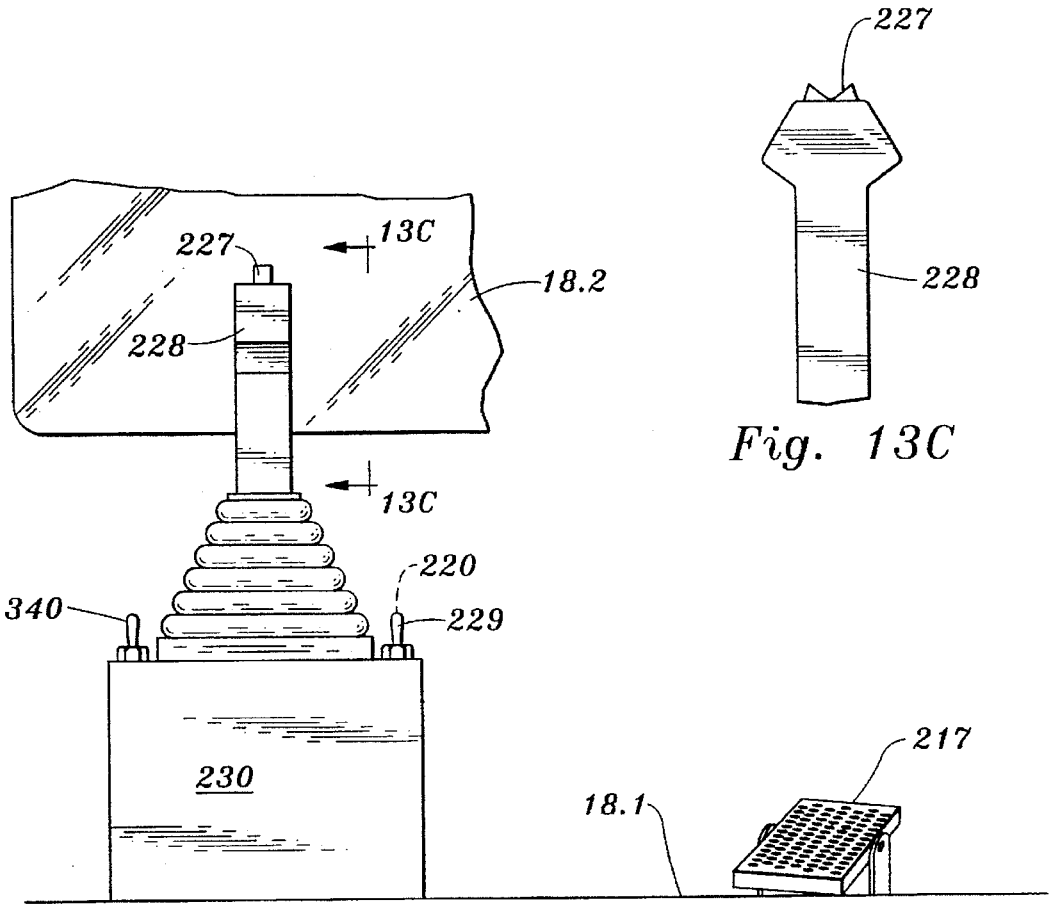
Fig. 13C
Fig. 13B

DOWNCROWDABLE TELESCOPIC AUGERING APPARATUS

BACKGROUND OF THE INVENTION

1. Field of the Invention.

The present invention relates to earth excavating equipment for drilling large diameter holes in the earth, and more particularly to heavy-duty mobile devices of the kind sometimes described as downcrowdable telescopic augering apparatus or drilling rigs.

2. Description of the Prior Art.

A downcrowdable telescopic augering apparatus is disclosed in U.S. Pat. No. 4,877,091, which was issued to Richard L. Howell, Jr., on Oct. 31, 1989, and is incorporated herein by reference.

The configuration of the downcrowdable telescopic augering apparatus of Howell is not well adapted to downcrowdable telescopic augering apparatuses which are considerably larger in size and greater in power than the commercially sold apparatuses of Howell.

For example, the downcrowdable telescopic augering apparatus of Howell, if considerably scaled up, would be characterized by a higher than desirable center of gravity, because of its proportionately heavy kelly winch and winch drive motor, mounted at the top of the proportionately heavier kelly tube, which could cause severe stability problems when the vehicle carrying the apparatus was being moved over rough ground.

Further, the configuration of the Howell apparatus does not lend itself well to the incorporation of a service winch, which is highly desirable for carrying out common operations generally associated with the drilling of foundation holes, etc.

Yet further, the apparatus of Howell, if modified by relocating the kelly winch at the end of the boom without modifying the control system thereof, would unduly burden the operator with the necessity of constantly checking the kelly cable and manipulating the operator controls, so that the kelly cable would not become slack, leading to cable pileup on the kelly winch drum, which can result in reduced cable life.

The scaling up of the apparatus of Howell to provide taller and more powerful downcrowdable telescopic augering apparatuses would make it difficult or impossible for the operator to view the kelly winch, which the operator must do repeatedly during the operation of a downcrowdable telescopic augering apparatus.

The term "prior art" as used herein or in any statement made by or on behalf of applicant means only that any document or thing referred to as prior art bears, directly or inferentially, a date which is earlier than the effective filing date hereof.

No representation is made that a comprehensive search of the prior art has been made, or that no more pertinent information exists.

A copy of U.S. Pat. No. 4,877,091, issued to Richard L. Howell, Jr. on Oct. 31, 1989, and entitled AUGERING APPARATUS AND DRILLING RIG, is supplied to the United States Patent and Trademark Office herewith.

SUMMARY OF THE INVENTION

Accordingly, it is an object of the present invention to provide downcrowdable telescopic augering apparatus which is larger in physical size and more powerful than the apparatus of Howell can practically be, and yet preserves at least some of the desirable features of the Howell apparatus.

Another object of the present invention is to provide augering apparatus having at least some of the desirable features of Howell, but wherein the kelly winch is mounted on the boom point connector structure or cradle rather than being mounted at the top of the kelly tube as taught in Howell.

Yet another object of the present invention is to provide augering apparatus having at least some of the desirable features of Howell and incorporating a service winch.

A further object of the present invention is to provide augering apparatus which has at least some of the desirable features of Howell, is taller and more powerful than the commercially sold devices of Howell, and at the same time is as stable as the commercially sold apparatus of Howell when the vehicle bearing it is being moved over rough terrain.

A yet further object of the present invention is to provide augering apparatus which has at least some of the desirable features of Howell, is taller and more powerful than the commercially sold apparatus of Howell, and provides a clear view of the kelly winch for the operator at all times.

Another object of the present invention is to provide augering apparatus which has at least some of the desirable features of Howell, has the kelly winch mounted on the boom point connector or cradle, and is provided with a winch management system whereby the operator is relieved of the burden of manipulating the operator controls to eliminate slack in the kelly cable whenever the kelly tube is moved downward with respect to the boom point connector or cradle.

Yet another object of the present invention is to provide augering apparatus which achieves at least some of the abovestated objects and which is provided with an automatic partial brake release system whereby the winch brakes are released sufficiently so that cable can be pulled off either winch without losing control of the load on the cable whenever the kelly tube is moved upward with respect to the boom point connector or cradle.

Other objects of the present invention will in part be obvious and will in part appear hereinafter.

The present invention, accordingly, comprises the several steps and the relation of one or more of such steps with respect to each of the others, and the apparatus embodying features of construction, combinations of elements, and arrangements of parts which are adapted to effect such steps, all as exemplified in the following disclosure, and the scope of the present invention will be indicated in the claims appended hereto.

In accordance with a principal feature of the present invention, downcrowdable telescopic augering apparatus of the Howell type is provided in which the kelly winch is mounted on the boom point connector or the cradle which surrounds the kelly tube and the kelly assembly.

In accordance with another principal feature of the present invention a service winch is mounted on said boom point connector or cradle.

In accordance with yet another principal feature of the present invention said downcrowdable telescopic augering apparatus of the Howell type includes a winch management system whereby the operator is relieved of the burden of manipulating the operator controls in order to eliminate slack in the winch cables each time the kelly tube is moved downward with respect to said cradle.

In accordance with a further principal feature of the present invention said winch management system includes automatic partial brake releasing means whereby the winch brakes are partially released, sufficiently so that cable can be pulled off both winch drums without breaking either cable or losing control of the load on the cable whenever the kelly tube is moved upward with respect to said cradle.

In accordance with a yet further principal feature of the present invention said winch management system includes service cable monitoring means comprising an arm to which the service cable hook can be attached when the service winch is not in use.

In accordance with another principal feature of the present invention said service cable monitoring means produces a first signal when said arm is raised, as by tension in the service cable when its hook is attached to said arm.

In accordance with yet another principal feature of the present invention said service cable monitoring means produces a second signal when said arm is lowered, as by disengagement of the service cable hook from said arm or the occurrence of slack in the arm-engaged service cable.

In accordance with a further principal feature of the present invention said winch management system includes operator override control means whereby the operator can suspend the operation of the winch management system, except for the cable slack takeup function and the partial brake release function.

In accordance with another principal feature of the present invention said winch management system includes a bottomhole cable arrester subsystem whereby the paying out of the kelly cable is automatically terminated whenever the bit of the auger of the present invention contacts the bottom of the hole which is being drilled thereby.

BRIEF DESCRIPTION OF THE DRAWINGS

FIG. 11 is a schematic diagram of the winch management system of the preferred embodiment of the present invention;

FIG. 12 is a tabular key to the schematic diagram of FIG. 11;

FIGS. 13A, 13B and 13C represent operator-manipulated controls of the present invention;

DESCRIPTION OF THE PREFERRED EMBODIMENTS

Figure 1:
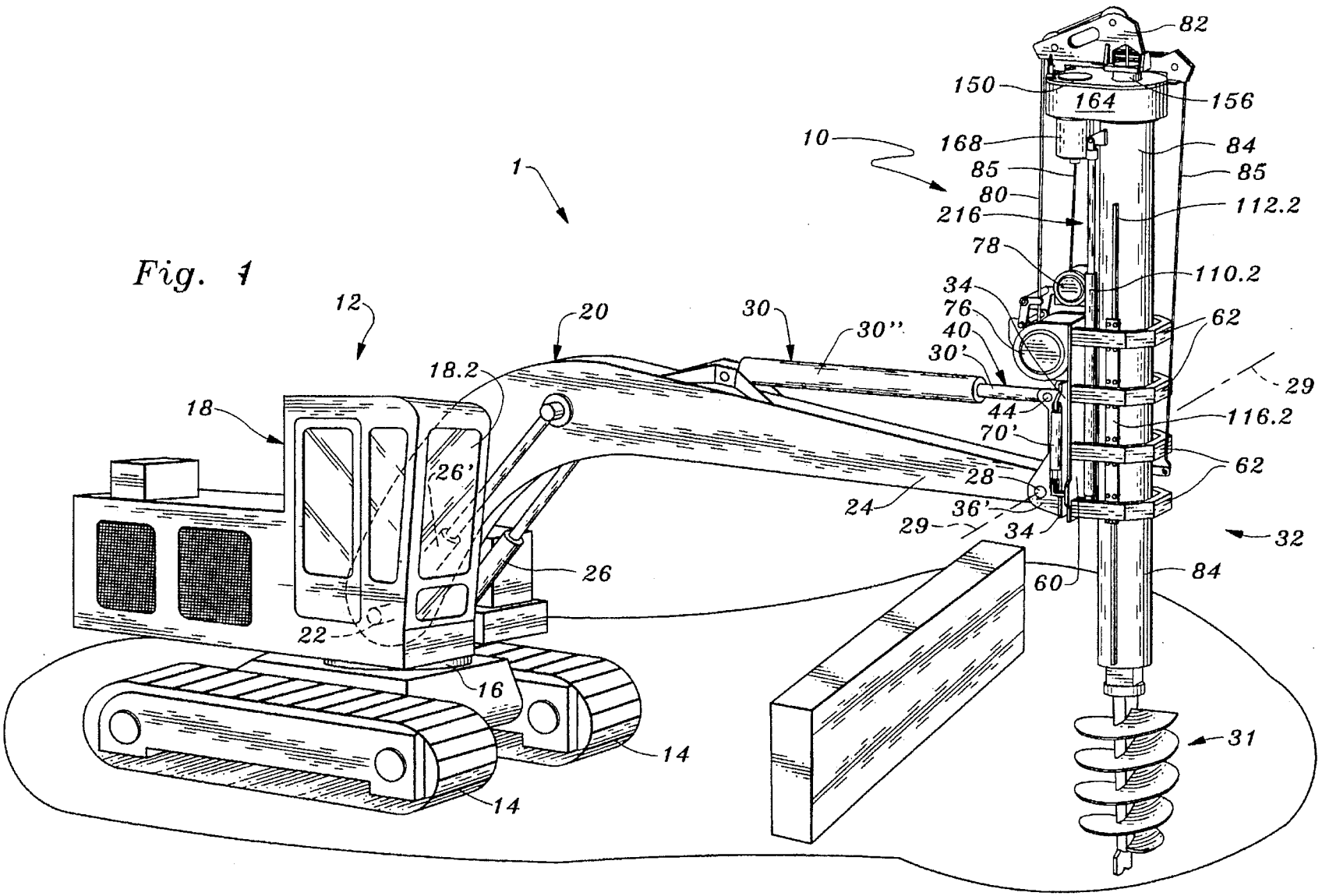
FIG. 1 is a perspective view of a downcrowdable telescopic augering apparatus of the present invention, including an auger of the present invention which is mounted on a crawler-type vehicle of well known configuration.

Referring now to FIG. 1, there is shown a downcrowdable telescopic augering apparatus 1 including an auger 10, both of the present invention.

As seen in FIG. 1, auger 10 is mounted on a vehicle which is indicated generally by the reference numeral 12. Vehicle 12 preferably is a crawler-type vehicle having treads 14 and a power-rotatable turntable 16. Mounted on turntable 16 are an operator cab 18 assembly and a boom 20. Boom 20 is pivotably attached to operator cab assembly 18 by means of a horizontal base pin 22 of well known type. Elevation of the distal end 24 of boom 20 is effected by means of hydraulic cylinders 26, 26'. Boom 20 supports distal end horizontal main pin 28 having a principal axis 29, and longitudinal tilt hydraulic cylinder means 30.

Figure 2:
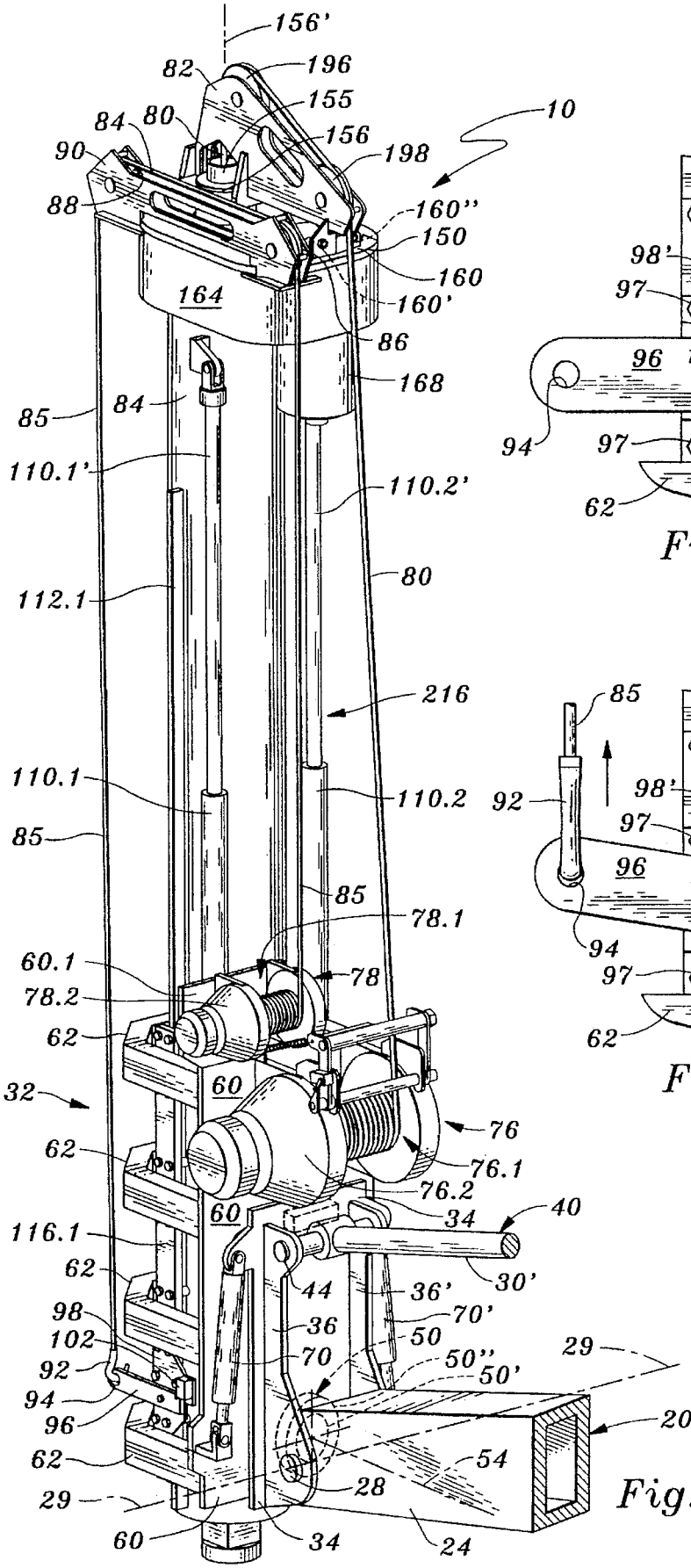
FIG. 2 is a perspective view of the auger of the first preferred embodiment of the present invention.

Referring now to FIG. 2, and comparing the same with FIG. 1, it will be seen that cradle 32 comprises main body member 34 to which is rigidly connected, preferably by arc welding, combined longitudinal tilt bearing means 36, 36'. Bearing means 36, 36' are preferably so juxtaposed as to closely surround distal end 24 of boom 20. Cradle 32 is pivotably mounted on main pivot pin 28, which passes through distal end 24 of boom 20 and is close-fittingly pivotably received in pin receiving holes in the lower ears of bearing means 36, 36'. The outer end 40 of the piston rod 30' of hydraulic cylinder means 30 is pivotably connected by horizontal pin 44 to the upper ears of bearing means 36, 36' (FIG. 2).

It will be appreciated by those having ordinary skill in the art, informed by the present disclosure, that tilting of cradle 32 about the axis of pin 28 can be brought about by a corresponding extension of piston rod 30' from cylinder 30" of hydraulic cylinder means 30 or a retraction of piston rod 30' into cylinder 30".

Preferably, cylinder means 30 has sufficient extension that bit 31 (FIG. 1) can be positioned substantially horizontally beneath boom means 20, i.e., so that main body member 34 can be disposed substantially horizontally below distal end 24 of boom 20.

In one preferred embodiment of the present invention, with bit 31 in the horizontal position just described, the entire augering apparatus 1, including auger 10 and vehicle 12, can transported on a low flatbed trailer, apparatus 1 and said trailer having a combined height which will not exceed about fourteen feet, thereby enabling trailer-carried augering apparatus 1 rig to pass under most bridges and overpasses.

The inner member 50' of a heavy-duty bearing 50 (FIG. 2) is received in a hole in main body member 34, and is affixed therein, as by arc welding.

Bearing 50 has an axis 54 which is perpendicular to main body member 34. Preferably, axis 54 is perpendicular to axis 29.

As seen in FIGS. 1 and 2, cradle 32 is further comprised of a backplate 60 and four U-shaped members 62 which are rigidly attached, preferably by arc welding, to backplate 60.

Bearing 50 is comprised of a hollow boss 50" which rigidly affixed to backplate 60, as by arc welding, and close-fittingly receives the inner part 50' of bearing 50 for rotation therewithin. Suitable retaining means (not shown) are provided for rotatably retaining inner part 50' in outer part 50". Thus, it will be seen that cradle 32 is pivotably mounted on boom 20, for pivoting about axis 54.

Bearing 50 corresponds in function to traverse bearing 60 of Howell.

As seen in FIGS. 1 and 2, augering apparatus 10 is comprised of a pair of traverse tilt hydraulic cylinder means 70, 70' by means of which augering apparatus 10 may be transversely tilted about axis 54 of bearing 50 (FIG. 2) in response to the manipulation of manual controls located in operator cab 18 (FIG. 1).

Hydraulic transverse tilt cylinders 70, 70' correspond substantially in function to the single cylinder 90 of Howell.

As best seen in FIG. 2, a hydraulically powered kelly winch 76, having a drum 76.1 and a power brake 76.2, is affixed the upper end of backplate 60, on the side thereof facing cab 18.

Figure 5:
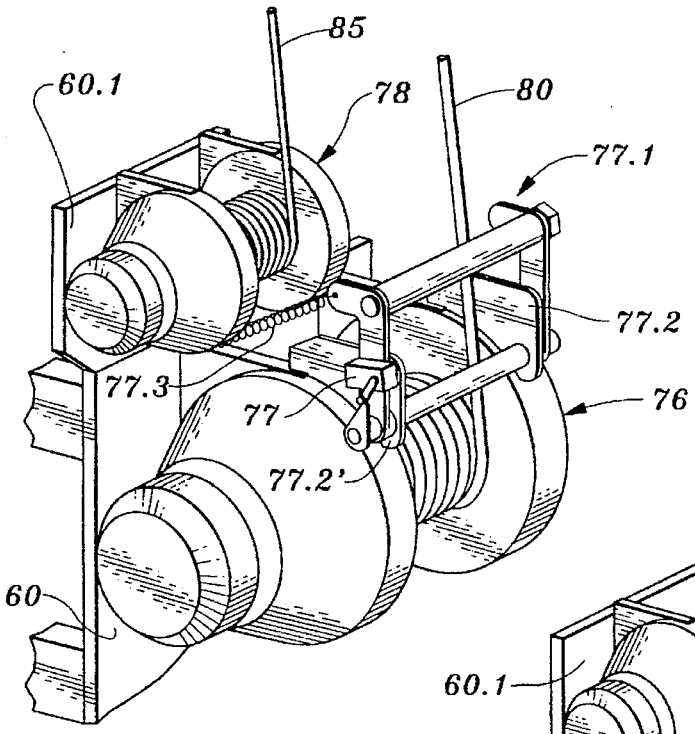
FIGS. 5 and 6 are perspective views of said kelly winch and said service winch, respectively showing the kelly cable monitoring means of the invention in two different states of operation.
Figure 6:
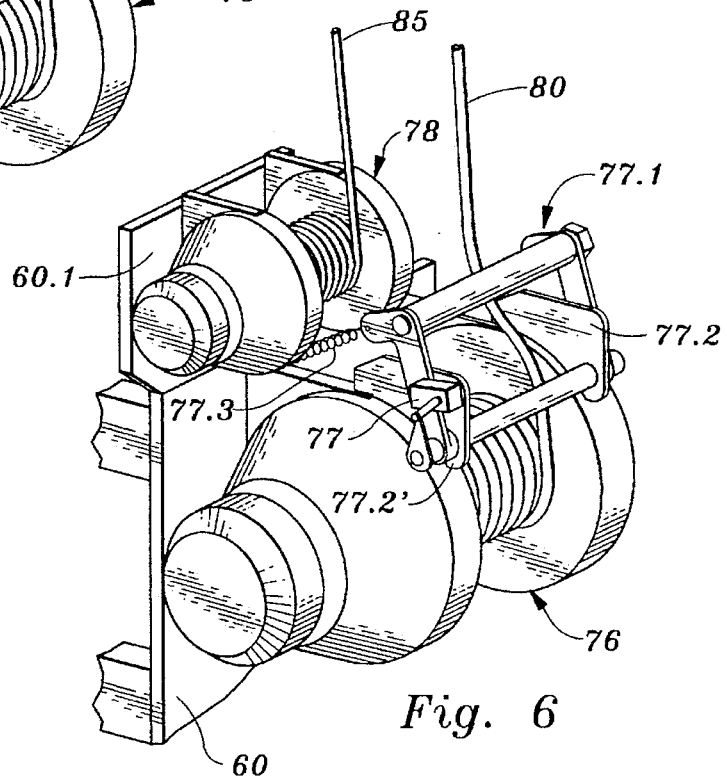

As may be seen by comparison of FIGS. 2, 5 and 6, an extension plate 60.1 is rigidly affixed to the top end of backplate 60, in such manner that the rearward face of backplate 60 (facing cab 18) and the rearward face of extension plate 60.1 remain at all times substantially coplanar.

As seen in FIGS. 2, 5 and 6, a hydraulically powered service winch 78, having a drum 78.1 and a power brake 78.2, is affixed to the rearward face of extension plate 60.1.

As seen in FIG. 2, a cable 80, which is in part wound on drum 76.1 of kelly winch ? 6, passes over the pulleys or sheaves 198, 196 of cable guide 82, and then extends vertically downwardy into the interior of kelly tube 84, which corresponds in general to elongated principal body 114 of Howell.

Since, as explained hereinafter, cable 80 is rotatably secured at its end remote from winch 76 to a kelly assembly 120 which is generally of the kind described and shown in Howells, and referred to therein by the reference numeral 160, cable 80 will sometimes hereinafter be called the "kelly cable", and winch 76 will sometimes hereinafter be called the "kelly winch".

As also seen in FIG. 2, the cable 85, which is wound in part on drum 78.1 of winch 78, passes over two pulleys 86, 88 which are themselves rotatably mounted in a cable guide 90.

The end of cable 85 remote from winch 78 is provided with a hook 92 (FIG. 2).

Hook 92 is adapted to be engaged with hook-receiving means such as eyes or slings, which hook-receiving means are incorporated into or attached to loads which it is desired to lift or move by means of the augering apparatus 1 of FIG. 1, and thus cable 85 will sometimes hereinafter be called the "service cable", and winch 78 will sometimes hereinafter be called the "service winch".

As further seen in FIG. 2, hook 92 may be engaged with an aperture 94 in the outer end of an arm 96 when service cable 85 and service winch 78 are not in use and it is desired to secure the outer end of service cable 85.

Figure 3:
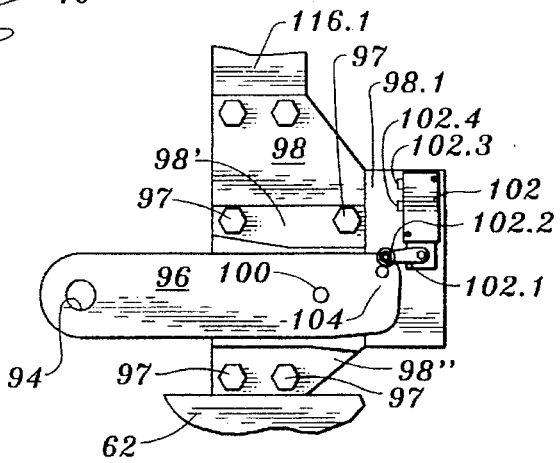
FIGS. 3 and 4 are elevational views of said service cable monitoring means, in two different states of operation.
Figure 4:
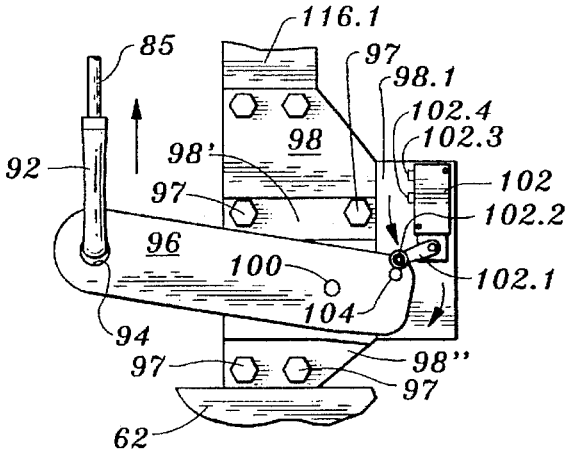

As may be seen by comparison of FIGS. 2, 3 and 4, hook-receiving arm 96 is pivotably mounted on a mounting plate 98 by means of a pivot 100, and stop plates 98', 98" are affixed to mounting plate 98 by bolts 97.

As seen in FIGS. 3 and 4, mounting plate 98 is provided with an extension plate 98.1 upon which is mounted a heavy-duty industrial snap-action switch 102 the actuator of which, in the well known manner, is a pivotable arm 102.1. Also in the well known manner, a roller 102.2 is rotatably mounted on the outer end of actuator arm 102.1.

As also seen in FIGS. 3 and 4, a pin 104 projects outwardly from the pivoted end of arm 96, and coacts with the roller 102.2 of actuating arm 102.1 of switch 102.

Switch 102 will sometimes be called the "service cable monitoring switch" hereinafter.

Switch 102 and its associated actuating mechanism (FIGS. 3 and 4) will sometimes be called the SCM or service cable monitoring system herein.

Switch 102 is so constructed and arranged, and so cooperates with arm 96 and pin 104, that it is open, i.e., terminals 102.3 and 102.4 are electrically disconnected from each other, when the outer end of arm 96 is in its lowermost position, i.e., when hook 92 is disengaged from aperture 94; and switch 102 is closed, i.e., terminals 102.3 and 102.4 are directly conductively interconnected, when the outer end of arm 96 is raised to its uppermost position by service cable 85 and hook 92, as shown in FIG. 4.

Thus, it will be evident to those having ordinary skill in the art, informed by the present disclosure, that the "stored service cable taut", or SSCT input signal tabulated in FIG. 12 is derived from terminals 102.3 and 102.4 of service cable monitoring switch 102, via insulated conductors which are omitted from FIGS. 2, 3 and 4 for clarity of illustration.

Comparing FIGS. 1 and 2, it will be seen that a pair of downcrowd hydraulic cylinder means 110.1, 110.2 interconnect tube 84 and the lower end of cradle 32.

Controlled slidable displacement of kelly tube 84 with respect to cradle 32 is effected by downcrowd hydraulic cylinder means 110.1, 110.2 in the manner in which controlled slidable displacement of housing means 112 relative to cradle means 66 is effected by downcrowd hydraulic cylinder means 122 of Howell, as described in the paragraph bridging columns 9 and 10 of Howell.

Again comparing FIGS. 1 and 2, it will be seen that a pair of rails 112.1, 112.2 are affixed to tube 84 at opposite extremities of mutually overlying diameters thereof.

Rails 112.1 and 112.2 function in substantially the same way, for substantially the same purpose, as guide means 120 of Howell.

Figure 2A:
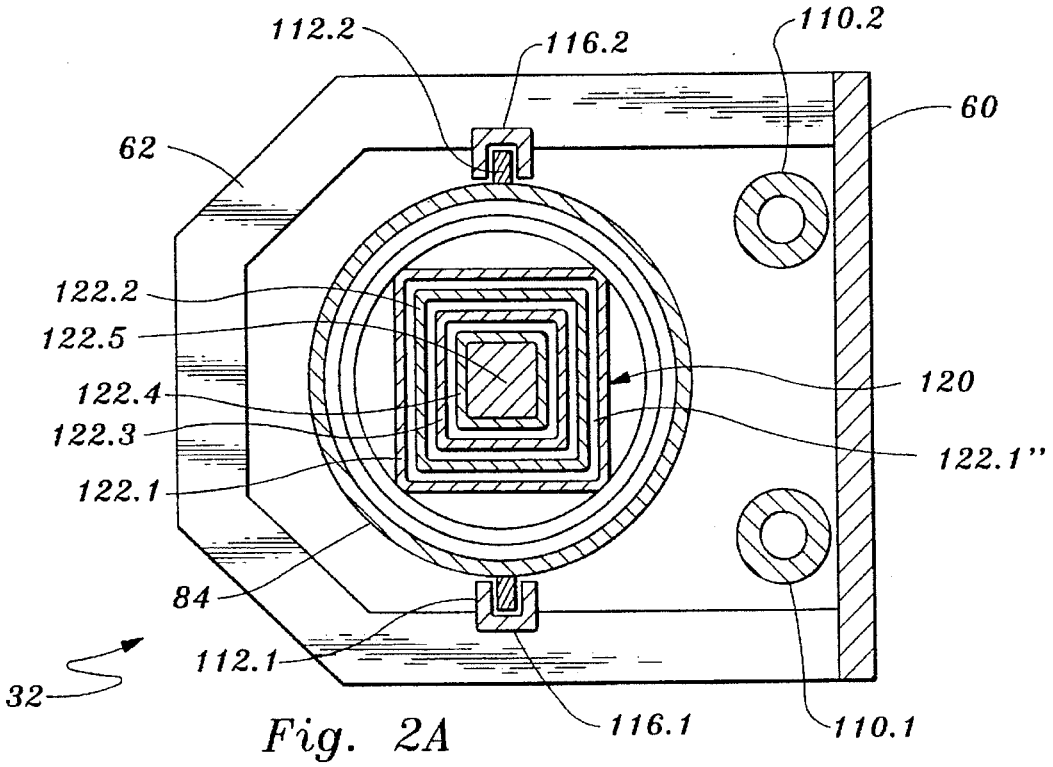
FIG. 2A is a cross-sectional plan view of said auger.

As seen by comparison of FIGS. 1, 2 and 2A, a pair of channels 116.1, 116.2 are affixed, as by arc welding, to indentations in the inner faces of the parallel sides of each of the U-shaped members 62 of cradle 32.

The floors of channels 116.1 and 116.2 thus confront and are affixed in said indentations in the inner faces of the parallel portions of U-shaped members 62, and thus the open faces of channels 116.1 and 116.2 are in mutual confrontation.

As will now be evident to those having ordinary skill in the art, informed by the present disclosure, and particularly by FIG. 2A, channels 116.1 and 116.2 are analogous in structure and operation to receptacle means 110 of Howell, and thus it will be understood that tube 84 is longitudinally slidably mounted in cradle 32 by means of rails 112.1, 112.2 and their coacting channels 116.1, 116.2.

Thus, it will be seen that kelly tube 84 is vertically slidably mounted within cradle 32, and thus is upwardly and downwardly movable within cradle 32 by the action of downcrowd hydraulic cylinder means 110.1, 110.2, in the same manner in which principal body 114 of Howell is upwardly and downwardly movable by the action of downcrowd hydraulic cylinder means 122 of Howell.

Figure 2B:
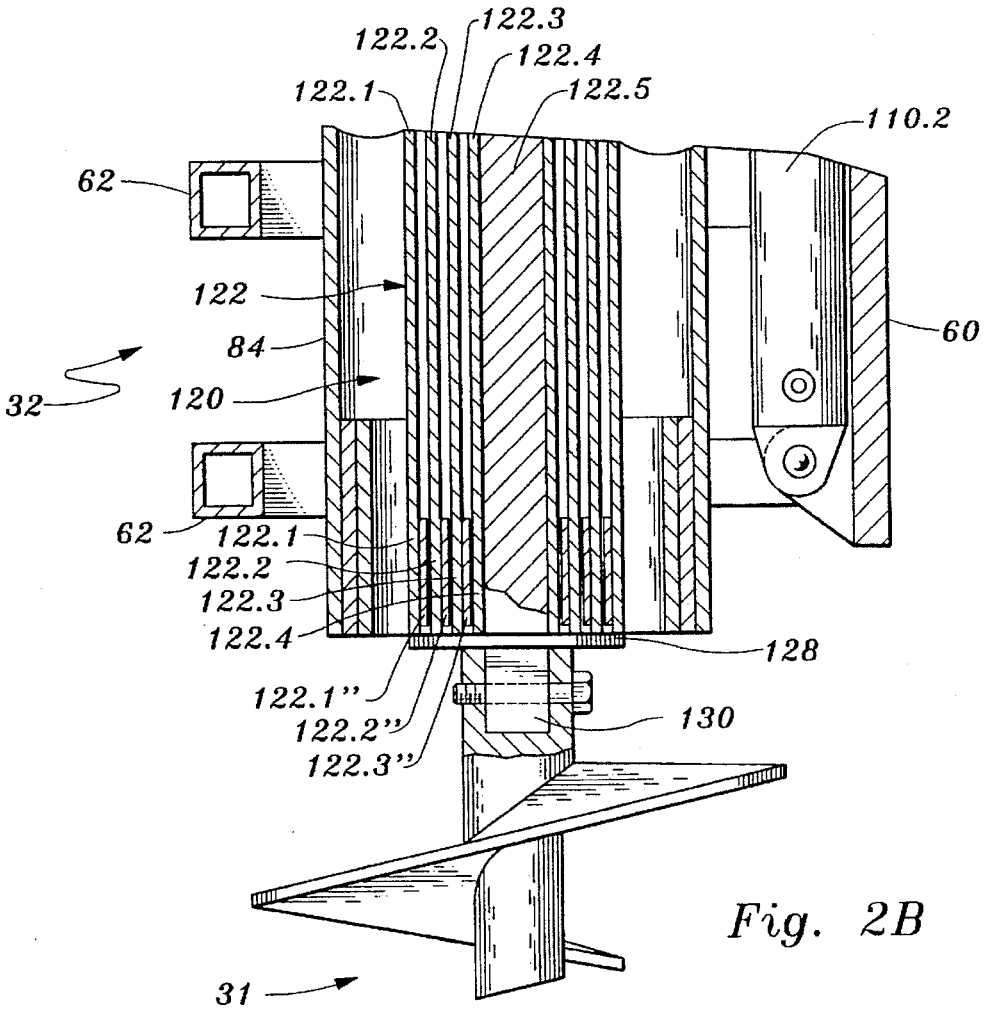
FIG. 2B is a partial cross-sectional elevational view of said auger.

Referring now to FIGS. 2A and 2B, the kelly assembly 120 located within kelly tube 84 will now be briefly described, it being understood that except as noted hereinbelow the telescoping kelly assembly 120 located within tube 84 is substantially like the telescoping kelly means 160 shown and described in Howell.

Kelly assembly 120 (FIG. 2A) is comprised of a telescoping plurality of square, hollow kelly sections, the outermost of which is designated by the reference numeral 122.1 and the innermost of which is designated by the reference numeral 122.4.

As best seen by comparison of FIGS. 2A and 2B, innermost kelly section 122.4 has a solid core 122.5', and all of the Kelly sections are of a square cross-section.

As explained in Howell, adjacent kelly sections are provided with cooperating pairs of retainers, e.g., 122.1" (FIG. 2B) cooperating with 122.2' (FIG. 9), 122.2" coacting with 122.3', etc., whereby they are maintained in telescoping relation when Kelly assembly 120 is fully extended.

Each retainer is affixed to the kelly section which has the same numerical reference component; each upper retainer has a primed reference numeral; and each lower retainer has a doubly primed reference numeral.

Rigidly attached, preferably by arc welding, to the lower end of the solid kelly section core 122.5, is liftplate 128 (FIG. 2B).

As kelly assembly 120 is telescoped, liftplate 128 successively contacts the lower ends of the other Kelley sections and, in outwardgoing order, lifts the other kelly sections back into kelly tube 84.

Integral with the lower end of said kelly section core 122.5, and located below liftplate 128, is coupling means 130 for the coupling to kelly section core 122.5 of bit 31 (FIG. 2B).

Figure 9:
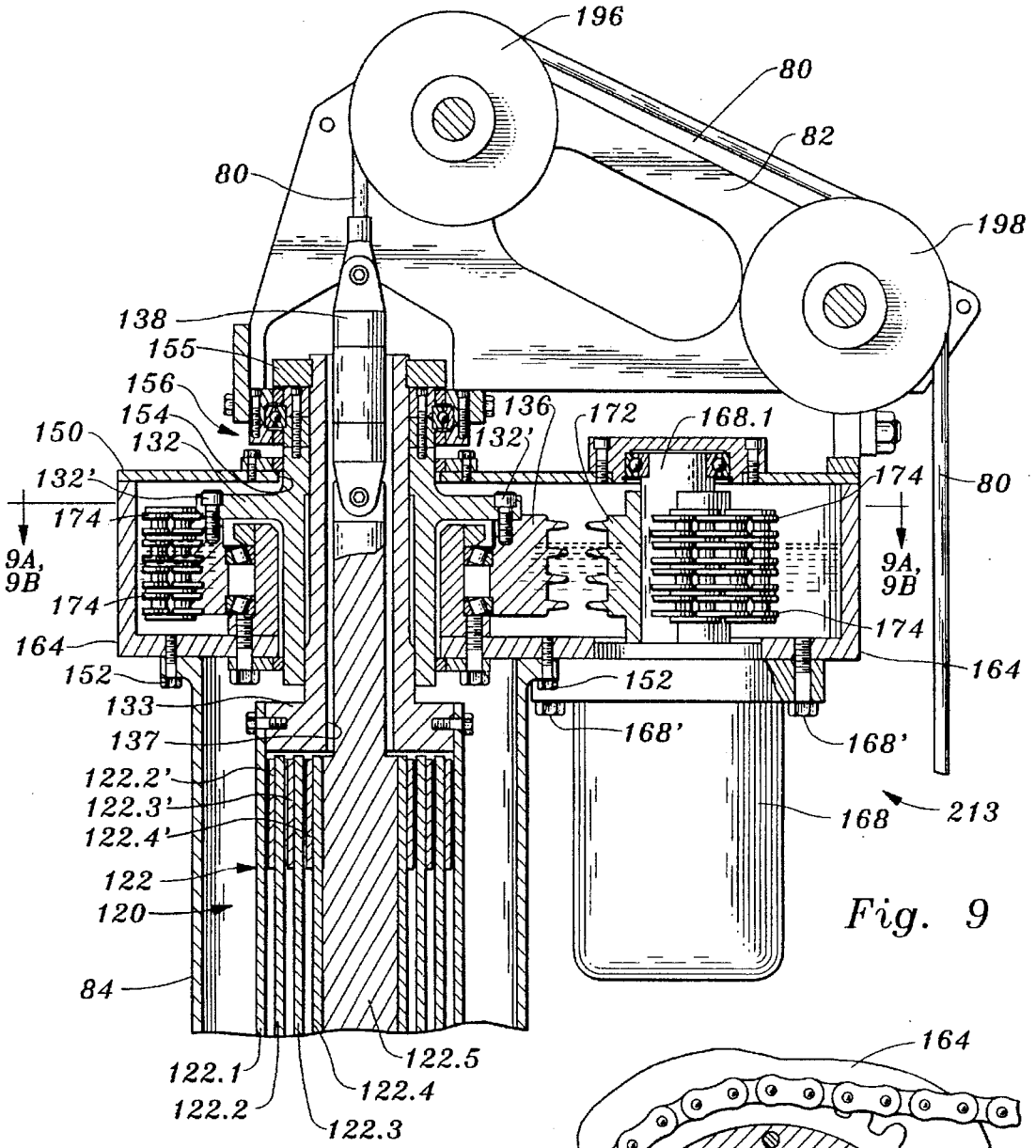
FIG. 9 is a partial vertical sectional view of the upper end of said kelly tube, including the drive motor for rotating said kelly assembly and the coupling means for coupling its output shaft to the quill means of the kelly assembly.

As best seen in FIG. 9, core 122.5 extends above the top of inner hollow kelly section 122.4.

As seen in FIG. 9, an inner quill member 133 is splined to an outer quill member 132 and is affixed to the upper end of outer kelly section 122.1.

It will be seen from FIG. 9 that inner quill member 133 is rotatable about the axis of kelly tube 84, but is incapable of longitudinal movement with respect to kelly tube 84.

As also seen in FIG. 9, outer quill member 132 is bolted to a sprocket 136, and a central bore 137 extends completely through member 133, from end to end thereof, and receives the reduced diameter upper end of core 122.5.

The outer end of kelly cable 80 is connected to a swivel assembly 138 which is swivelly connected to said upper end of solid kelly section core 122.5.

As may be seen by comparison of FIGS. 2 and 9, a headplate 150 covers a housing 164 which is mounted upon kelly tube 84 by means of a plurality of bolts 152.

Headplate 150 overlies sprocket 136 (FIG. 9). A circular aperture 154 passes through headplate 150 and loose-fittingly receives outer quill member 132.

A split collar 155 is received in a groove in the upper end of member 133 and overlies bearing 156 by means of which kelly cable guide 82 is rotatably mounted on the upper end of member 132.

Figure 10:
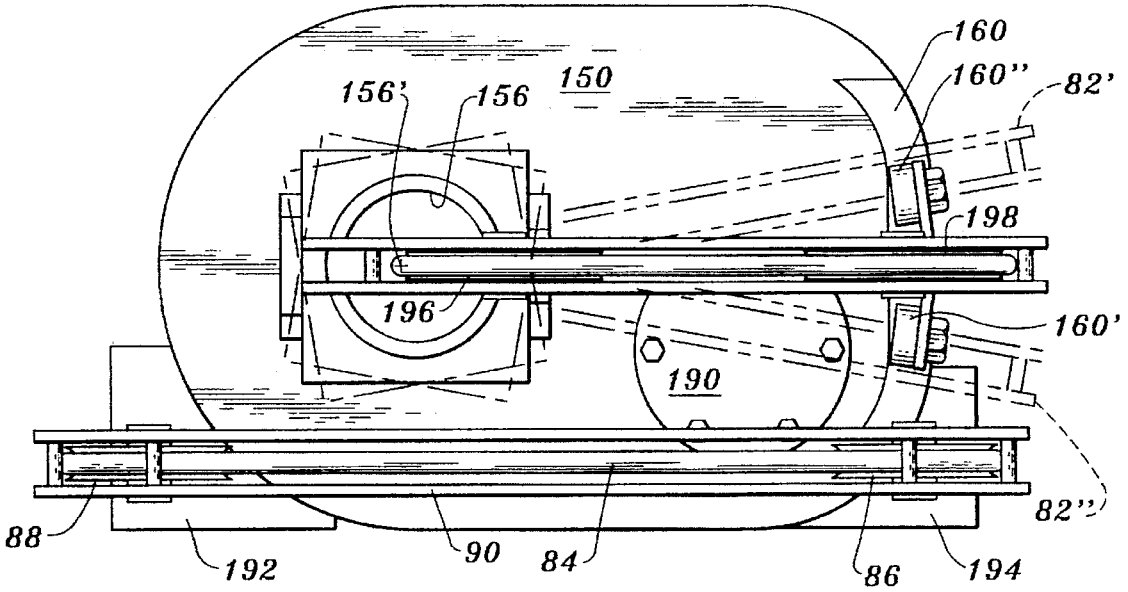
FIG. 10 is a plan view of the apparatus shown in FIG. 9.

The outer end of kelly cable guide 82 is movably supported by two rollers 160', 160" (FIG. 10) which ride on an arcuate hardened plate 160 (FIG. 10).

As also seen in FIG. 2, service winch cable guide 90 is affixed to housing 164.

As may be seen by comparison of FIGS. 1, 2, and 9 a hydraulic drive motor 168 is located beneath housing 164, with its output shaft 168.1 disposed within housing 164.

Hydraulic drive motor 168 is fixedly mounted with respect to housing 164 by means of bolts 168'.

Figure 9B:
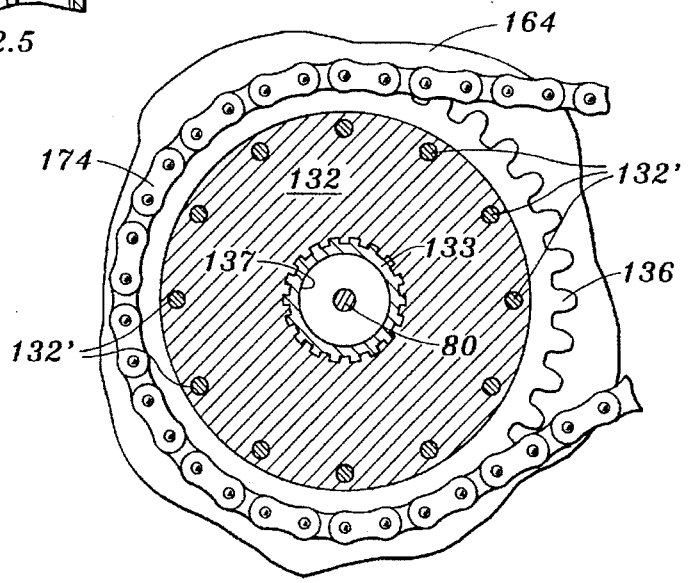
FIG. 9B is a partial cross-sectional view of the apparatus shown in FIG. 9, taken on plane 9A, 9B.
Figure 9A:
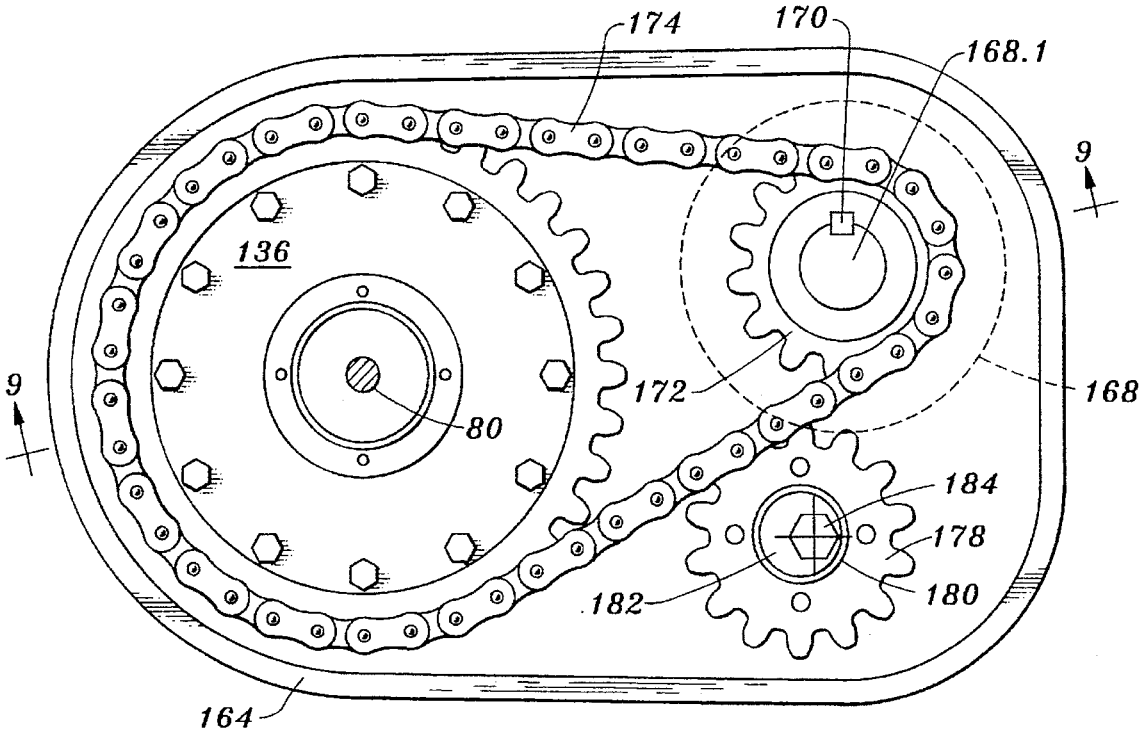
FIG. 9A is a cross-sectional view of the chain drive mechanism shown in FIG. 9, taken on plane 9A, 9B.

Referring now to FIG. 9A, it will be seen that the output shaft 168.1 of hydromotor 168 is keyed by means of a key 170 to a sprocket 172.

As seen in FIG. 9, a multi-strand drive chain 174 of well known type coacts with the several sets of teeth of sprockets 136 and 172 for synchronous rotation of sprockets 136 and 172.

As seen in FIG. 9A, a mutually joined together set of gears or a unitary corncob gear 178 is freely rotatably mounted on a hollow cylindrical collar 180, each gear or coplanar set of corncob teeth coacting with one strand of chain 174.

The cupped lower end 182 of collar 180 is provided with an eccentric aperture whereby it is mounted on the shaft of a bolt 184.

Thus, it will be seen by those having ordinary skill in the art, informed by the present disclosure, that, with bolt 184 loosened, collar 180 may be rotated about the axis of said eccentric aperture, thereby tensioning chain 174, and then may be maintained in any selected tensioning position by tightening bolt 184.

FIG. 9B shows the mutual collocation of sprocket 136, inner quill member 133, and outer quill member 132.

Referring now to FIG. 10, there is shown the upper surface of headplate 150 through which passes an aperture covered by a bolted service plate 190. Service plate 190 is provided to give access to collar 180 and bolt 184 (FIG. 9A), for the purpose of adjusting idler gearset or "corncob" 178 in the manner described hereinabove.

As seen in FIG. 10, service winch cable guide 90, which guides service cable 85, reeved over winch cable guide sheaves or pulleys 86, 88, is affixed to housing 16.

As also seen in FIG. 10, kelly cable 80 is reeved over sheaves or pulleys 196 and 198 of kelly cable guide 82.

As further seen in FIG. 10, kelly cable guide 82 is pivotable about the axis 156'. This pivoting of kelly cable guide 82 is aided by rollers 160', 160" which ride on a fixed, arcuate hardened plate 160.

The winch management system 200 of the preferred embodiment of the present invention is shown in FIGS. 11 through 15 and described hereinafter in connection with FIGS. 11 through 15.

Before the winch management system 200 of the preferred embodiment of the present invention is described in detail, however, it is desirable to discuss the reasons for the provision of the winch management system.

As pointed out hereinabove, it is a principal teaching of the present invention that kelly winch 76 is mounted on cradle 32, rather than at the top of kelly tube 84 in accordance with the teachings of Howell.

The mounting of kelly winch 76 on the cradle 32, however, made necessary the provision of the winch management system 200, which is a principal feature of the present invention and is shown and described hereinafter in connection with FIGS. 11 through 15, and in particular the cable protection subsystem thereof.

It is also to be noted that the cable protection subsystem of winch management system 200 makes the provision of a service winch, which is a principal feature of the present invention, feasible.

In other words, while the mounting of the kelly (76) and service (78) winches on cradle 32 solved several problems, such stability, visibility, etc., it required the provision of the cable protection subsystem of winch management system 200 of the present invention.

Winch management system 200, and particularly cable protection subsystem 200.1, is required in order to deal with the problems raised by the relative motion between kelly tube 84 and cradle 32, in accordance with the teachings of the present invention.

Among these problems are the following major problems, which are discussed here in connection with the kelly winch, it being understood that similar problems arise in connection with the service winch.

Figure 8:
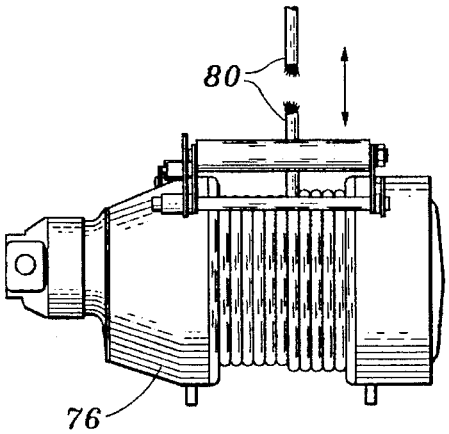

When bit 31 is in its home position (FIG. 2B) as kelly tube 84 is being moved upward by the action of downcrowding cylinders 110.1, 110.2, kelly cable 80 will tighten and break (FIG. 8) unless it is correspondingly payed out or kelly winch brake 76.2 (FIG. 2) is released, and preferably partially released so that kelly cable 80 can be pulled off kelly winch drum 76.1 (FIG. 2) but cannot run free, as taught by the present invention.

Since kelly tube 84 is moved up and down hundreds of times a day, it would be totally impracticable to require the operator to thus pay out kelly cable 80 or partially release kelly winch brake 76.2 each time kelly tube 84 is raised.

To render such operator intervention unnecessary, the provision of a subsystem (PBR/K) for automatically releasing kelly winch brake 76.2 enough to allow cable to be pulled off kelly winch drum 76.1 without losing control of kelly assembly 120 was conceived of as part of the present invention. This PBR/K subsystem directs a small amount of hydraulic oil from the hydraulic subcircuit which extends the crowding cylinders 110.1, 110.2, through a pressure regulating valve 100.4, to an external brake release port 76.3 on the kelly winch. The pressure supplied at the external brake release port 76.3 is maintained very accurately, and thus the kelly winch brake is released sufficiently so that cable can be pulled off the kelly winch drum without breaking the kelly cable, but the kelly winch brake is not released sufficiently to lose control of the kelly assembly 120. Said small amount of oil, i.e., the PBR/K signal, is derived from valve 100.4 (FIG. 13) via hydraulic line 100.5 (the PBR signal line).

Figure 7:
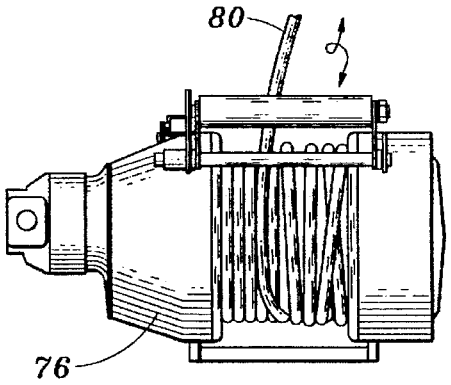
FIGS. 7 and 8 show said kelly winch in two different conditions which the winch management system of the invention serves to avoid.

On the other hand, when kelly tube 84 is moved downward by downcrowding cylinders 110.1, 110.2, the kelly cable, without subsystem PBR/K, will become slack (FIG. 7).

This kelly cable slack condition is objectionable because when it occurs kelly cable 80 will not maintain uniform wrap on kelly cable drum 76.1, but rather will become disarrayed (FIG. 7). As is well known to those having ordinary skill in the art, the avoidance of such cable disarray is critical for extended cable life.

Thus, in accordance with the teachings of the present invention, in order to maintain suitable tension on the kelly cable when kelly tube 84 is moved downward, a small portion of hydraulic oil from the circuit branch which lowers kelly tube 84, i.e., retracts downcrowding cylinders 110.1, 110.2, is routed by a kelly cable reel in (RI/K) subsystem of the invention, comprised of a separate pressure regulating valve, to the hoisting port of the kelly winch motor.

The pressure received at the kelly winch motor hoisting port is precisely factory set so that the kelly winch will only take slack out of the kelly cable but will not otherwise effect the kelly assembly 120.

A partial service winch brake releasing subsystem (PBR/S) (FIG. 13)and a service cable reel in subsystem (RI/S) are provided in connection with service winch 78 to perform substantially the same functions in connection therewith.

Proper control of service winch 78 requires the provision of an additional winch management subsystem which is not required in connection with kelly winch 76.

As explained hereinabove, service winch 78 is constructed and arranged to raise various loads which must be raised in connection with certain augering operations by means of its cable 85 and hook 92.

As is well known to those having ordinary skill in the art, it is frequently necessary or desirable that service winch 78 be used to hold a load while, at the same time, kelly tube 84 is raised. In this situation the service winch partial brake release system (PBR/S) must be deactivated or disabled in order to avoid the possibility of losing control of the load borne by hook 92 of service winch cable 85.

As will be obvious to those having ordinary skill in the art, informed by the present disclosure, the service winch cable reel in subsystem (RI/S) of the present invention does not affect the load holding or carrying ability of the service winch.

In accordance with a principal feature of the present invention, the service cable reel in subsystem (RI/S) of the present invention is comprised of switch 102 and hook-receiving arm 96 shown in FIGS. 2, 3 and 4, and described hereinabove in connection therewith.

When hook 92 attached to service cable 85 is engaged with hole 94 in hook-receiving arm 96, and service cable 85 is reeled in, hook-receiving arm 96 is pulled upwardly, and thus hook-receiving arm 96 is drawn into its uppermost position, as shown in FIG. 4, and associated switch 102 is closed.

When hook-receiving arm 96 is in its uppermost position, as shown in FIG. 4, switch 102 (closed) serves to activate the service winch partial break release system (PBR/S).

If service cable 85 is not engaged with hole 94 in arm 96, i.e., service cable 85 is deployed to pick up a load, arm 96 is in its lowermost position (FIG. 3), switch 102 is open and the service winch partial brake release system (PBR/S) is deactivated.

It is not necessary when service cable 85 is thus deployed to disable the PBR/K subsystem, because kelly winch 76 has a dedicated load, i.e., kelly assembly 120 and a drilling tool, such as auger 31 shown in FIG. 1.

Thus, the PBR/K subsystem is set at the factory to operate properly over the range of loads which will be applied to kelly winch 76 and kelly cable 80.

Service winch 78 and service cable 85, on the other hand, are at different times loaded with a wide range of loads, i.e., no load when not in use, to a full capacity load, and anything in between.

As will be evident to those having ordinary skill in the art, informed by the present disclosure, it would not be desirable to modify the operation of the brake of service winch 78 while service winch 78 is managing any type of load. Thus, in accordance with the present invention, the PBR/D/S subsystem, including switch 102 (FIGS. 2, 3, and 4), assures that the partial release of the brake 78.2 of service winch 78 occurs only during the inactive condition of service winch 78, when arm 96 is in its uppermost position (FIG. 4), and switch 102 is in its first (closed) state.

In view of the above it will now be understood by those having ordinary skill in the art, informed by the present disclosure, that the power and control system (PCS) which motivates and provides operator control in the downcrowdable telescopic augering apparatus 1 of the first preferred embodiment of the present invention is comprised of a winch management system (WMS) which is a principal feature of the present invention.

It will further be understood that while said winch management system (WMS) is separately denominated herein, it is in fact an integral part (subsystem) of said power and control system (PCS), and does not carry out its functions independently thereof.

It will yet further be understood that said winch management system, and the functional subsystems thereof described below, are integral parts of the PCS system and do not carry out their functions independently thereof.

The winch management subsystem (WMS) of the PCS system is comprised of two PBR or partial brake release subsystems, viz., the kelly winch partial brake release subsystem (PBR/K) and the service winch partial brake release subsystem (PBR/S).

Figure 13:
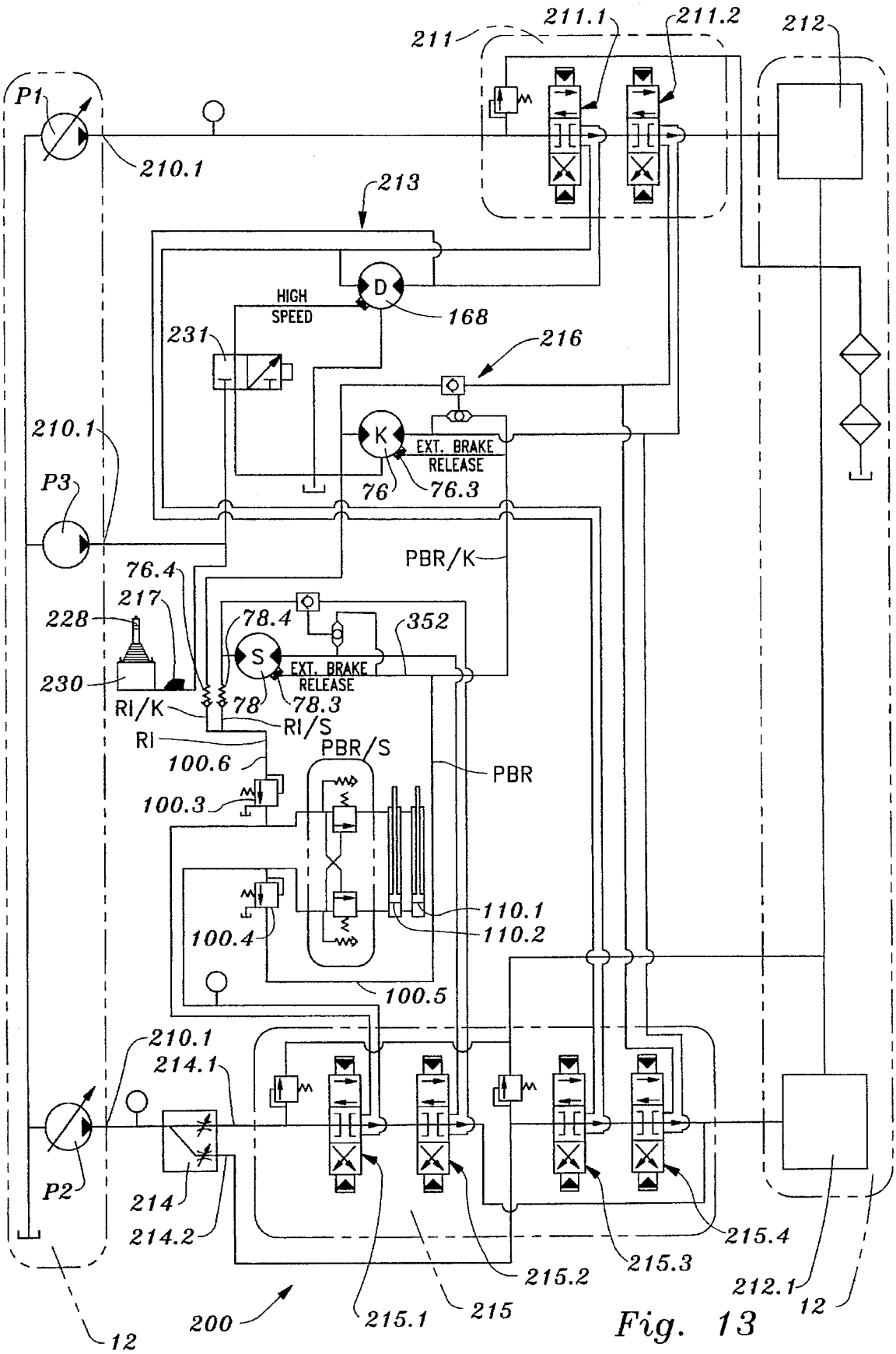
FIG. 13 is a schematic diagram of the winch management system of the first preferred embodiment of the present invention.

Both of these subsystems, PBR/K and PBR/S are shown schematically in FIG. 13. PBR/K is directly connected to external brake release port 76.3 of kelly winch 76, and PBR/S is directly connected to external brake release port 78.3 of service winch 78. The input signal (PBR) to both of these subsystems is derived from is hydraulic line 100.5 (FIG. 13). The PBR signal pressure typically 400 pounds per square inch, and is set at the factory the time of manufacture of each augering apparatus of the present invention.

The WMS subsystem of the PCS system is further comprised of two RI or cable reel in subsystems, viz., the kelly cable reel in subsystem (RI/K) and the service cable reel in subsystem (RI/S).

Both of these subsystems, RI/S and RI/K, are shown schematically in FIG. 13. RI/S includes check valve 78.4, and RI/K includes check valve 76.4. The RI/S and RI/K signal pressure (RI) is supplied by hydraulic line 100.6. PBR signal pressure is typically between 300 and 400 p.s.i., and is set at the time of manufacture of each augering apparatus of the invention.

The WMS subsystem of the PCS system is further comprised of a service winch partial brake release subsystem disabling or deactivating subsystem (PBR/D/S).

As will now be understood by those having ordinary skill in the art, informed by the present disclosure, the functional terms PBR/K, PBR/S, RI/K, RI/S, and PBR/D/S, as define, hereinabove, are not to be taken to imply that each is an independent subsystem. To the contrary, for example, it will now be evident to those having ordinary skill in the art that the PBR/D/S subsystem is a part of the PBR/S subsystem.

The power and control system (PCS) of the downcrowdable telescopic augering apparatus 1 of the first preferred embodiment of the present invention as shown in FIG. 1 is comprised of the electrical and hydraulic system of vehicle 12 and the electrical and hydraulic system of auger 10 of the present invention (FIG. 1).

The first of these will sometimes hereinafter be called the vehicle power and control system (VPCS), and the second of these will sometimes hereinafter be called the auger power and control system (APCS).

The APCS integrates the electrical and hydraulic components of auger 10 (e.g., switches 77 and 102, the hydraulic drive motor 168 for rotating kelly assembly 120, crowding cylinders 110.1, 110.2) into the electrical and hydraulic system of vehicle 12 (VPCS), and thus powers and controls the operation of auger 10.

The auger power and control system (APCS) will in general be referred to hereinafter by the reference numeral 210.

The vehicle power and control system (VPCS) will not be described in detail herein, since systems of that type are well known to those having ordinary skill in the art.

A vehicle which may be used as vehicle 12 is a Model 225 Caterpillar excavator.

Boom 20 is to be understood to be a part of vehicle 12, as is boom positioning cylinder 30, 30', 30".

Main body member 34, including tilt bearing means 36, 36', horizontal main pin 28, horizontal pin 44, and the entire assembly mounted on main body member 34 will be understood to be the auger 10 of the present invention.

FIG. 13 represents winch management system (WMS) 200 of the invention, with the exception of portions of excavator or vehicle 12 shown in broken lines, winches 76 and 78, and drill motor 168.

As represented schematically in FIG. 13, vehicle 12 includes three hydraulic pumps P1, P2, P3 which are driven by the internal combustion engine of vehicle 12. Pumps P1, P2, and P3; supply all of the pressurized hydraulic fluid used to operate the hydraulic components of auger power and control system 210, including the low pressure hydraulic control system thereof, which is supplied by pump P3.

In FIG. 13, boxes 212, 212.1 represent valves which are part of excavator or vehicle 12.

Electrical power for use in the electrical control portion of APCS 210 is provided by the electrical system of vehicle 12.

The output port of each of the three pumps P1, P2, P3 is connected to an auger control panel 210.1 which is mounted on vehicle 12.

As seen in FIG. 13, APCS 210 is comprised of a two-section power-beyond control valve 211. Control valve 211 may be an HC-D20/2E2(310 )R5S4C17R3VA1(210)VB1 (210)S4C17R3VA1 (140)VB1(140) U2R26 valve, which may be purchased from the Hydrocontrol S.r.1.(Bologna), 40060 Osterid Grande (BO) Italia-via s. Giovanni, 481.

As indicated by the above manufacturer's valve type designator, valve 211 is a two section valve which is comprised of an inlet section 211.1 the relief of which is set at 4500 psi an, which has an ST threaded port 211.2; a first section 211.3 which includes a motor spool 211.4 and a work port 211.5 the relief of which is set at 3000 psi; an ST threaded port 211.6, and a hydraulic remote 211.7; a second section 211.8 having a motor spool 211.9 with a working port the relief of which is set at 2000 psi; an ST threaded port 211.10 and a hydraulic remote 211.11; and an outlet section 211.12 including a power-beyond valve 211.13 with an ST threaded port 211.14.

The power-beyond port of valve 211.13 of outlet section 211.2 of valve 211 is connected to the control valve bank 212 of vehicle 12.

When the spool of the first section 211.3 of valve 211 is positioned to conduct hydraulic fluid in either fluid flow direction, oil from pump P1 is supplied to hydraulic motor 168 to rotate kelly section 120 in the corresponding direction.

The second section 211.2 of valve 211 controls kelly winch 76.

The oil flow provided by pump P2 is routed through flow divider 214 (FIG. 13).

The output connections 214.1, 214.2 of flow divider 214 are respectively connected to the inlet sections 215.1, 215.2 of a four-section mid-inlet power-beyond valve 215. Valve 215 may be an HC-D20/4E2(310)R5S4C17R3VA1(105) VB1(105)S 4C17R3VA1 (140)VB1(140) 1E2(310) R3S1C17R3VA1(210)VB1(210)S1C17RCVA1(140)VB1 (140)U2R26 valve, which may be purchased from the same valve manufacturer, viz., Hydrocontrol S.r.1.-of Bologna, Italy. The structural arrangement of valve 215 will be understood by those having ordinary skill in the hydraulic valve art, in view of the same manufacturer's valve type designator code used above in connection with the description of control valve 211.

Section 215.1 of valve 215 (FIG. 13) controls the crowd assembly which is principally comprised of cylinders 110.1 and 110.2 (FIG. 2).

As will be seen by those having ordinary skill in the art, informed by the present disclosure, and particularly FIG. 13, section 215.2 of valve 215 controls service winch 78.

As will also be evident to those having ordinary skill in the art, informed by the present disclosure, and particularly FIG. 13, section 215.3 of valve 215 adds flow from flow divider 214 to auger circuit 213.

As may also be seen by those having ordinary skill in the art, informed by the present disclosure, and particularly FIG. 13, section 215.4 of valve 215 adds flow from pump P2 to the driving fluid stream of kelly winch 76, whereby to increase the speed of kelly winch 76.

As also seen in FIG. 13, when oil is directed to retract the crowd cylinders 110.1, 110.2 (crowd down) a portion of this oil is routed to the kelly and service winches through pressure reducing valve 100.3, which causes them to reel in their respective cables (RI function).

When the crowd cylinders 110.1, 110.2 are being extended, oil is directed to the winch brake circuits through pressure reducing valve 110.4. Just enough pressure is applied to the winch brakes to allow cable to be pulled off the winch drums without breaking the winch cables (PBR function).

As also seen in FIG. 13, the winch controller, which is a foot pedal 217 in cab 18, operates the kelly winch sections 211.2 and 215.4 of valves 211 and 215 simultaneously, so that the kelly winch is always operated by flow from both pumps P1 and P2.

Service winch 78 is also controlled by foot pedal 217. A selector switch 220 at the right front of the control pedestal 230 controls a selector valve 221 which transfers the control function of foot pedal 217 from the kelly winch valves to the service winch valve.

Figure 17:
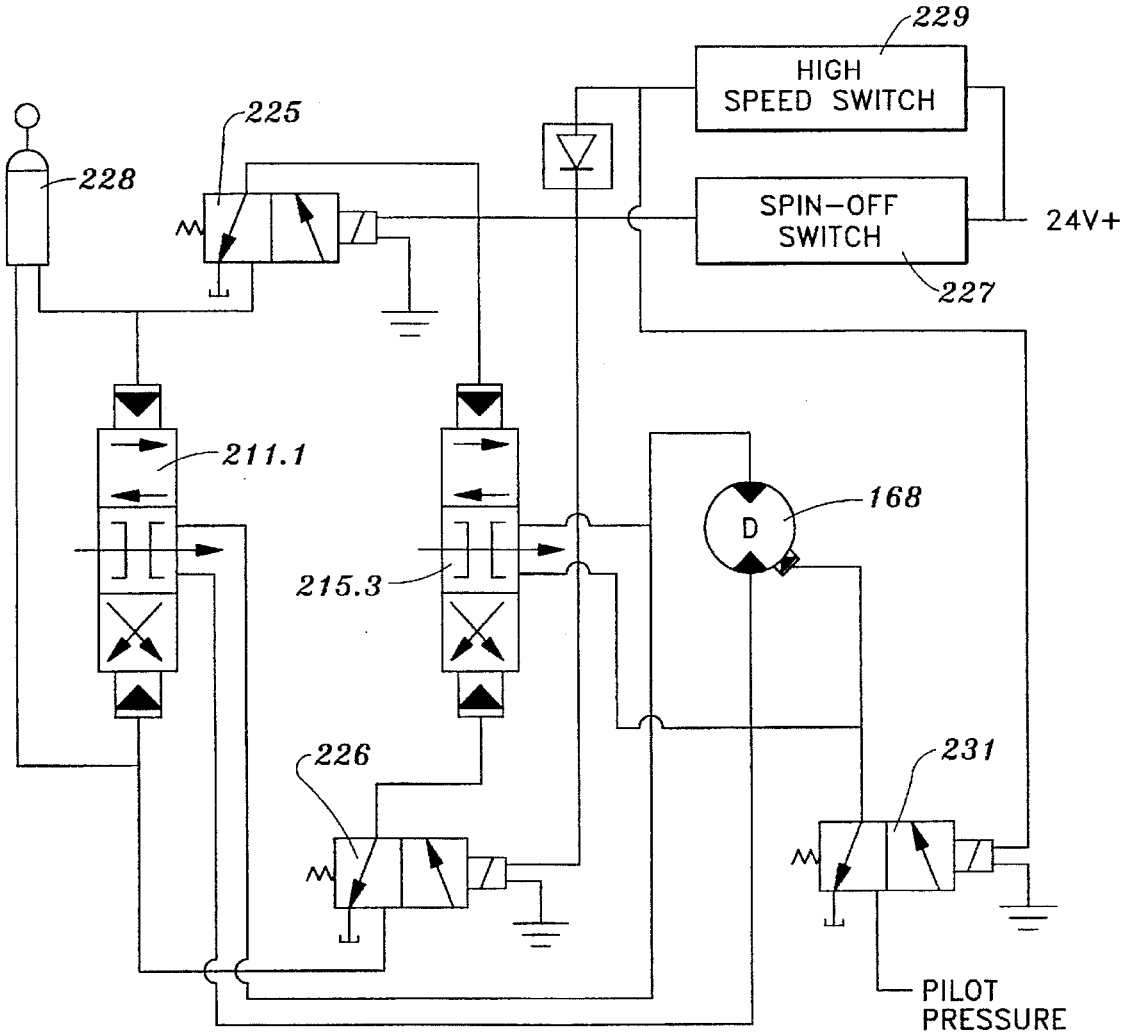
FIG. 17 is a schematic diagram of the auger control subsystem of the power and control system of the telescopic augering apparatus of the first preferred embodiment of the present invention.

The drill power and control subsystem (DPCS) (FIG. 17) directly controls the drill valve 211.1, which is connected to pump P1 (FIG. 13) and also to the drill valve 215.3 connected to pump P2 (FIG. 13) by way of two solenoid valves 225, 226 (FIG. 17).

A rocker switch 227 on the joy stick 228, and a toggle switch 229 at the right rear of the pedestal 230 (FIG. 13A) control solenoid valves 225, 226.

When toggle switch 229 is in its rearward position, drill controller 228 (FIG. 17) only operates drill valve 211 from pump P1. This results in low speed operation of auger 31.

When toggle switch 229 is in its forward position, solenoid valves 225, 226 (FIG. 17) cause drill controller 228 (FIG. 17) to operate the drill sections of both valves 211 and 215 (FIG. 13) so that auger 31 rotates at high speed.

When rocker switch 227 (FIGS. 13A, B and C) mounted on the joy stick 228 (FIGS. 13A, B and C) is closed by rocking it fully backward or forward from its spring-loaded, normal center position, the solenoid valves 225, 226 (FIG. 17) are energized and the solenoid valve 231 which controls the displacement pilot of the drill motor (168. FIG. 17) is energized. This results in auger 31 rotating in the spin-off mode.

The rotary and crowd functions are controlled by joy stick controller 228 which is mounted on control pedestal 230 (FIG. 13A and FIG. 13B) located directly in front of the operator.

Figure 16:
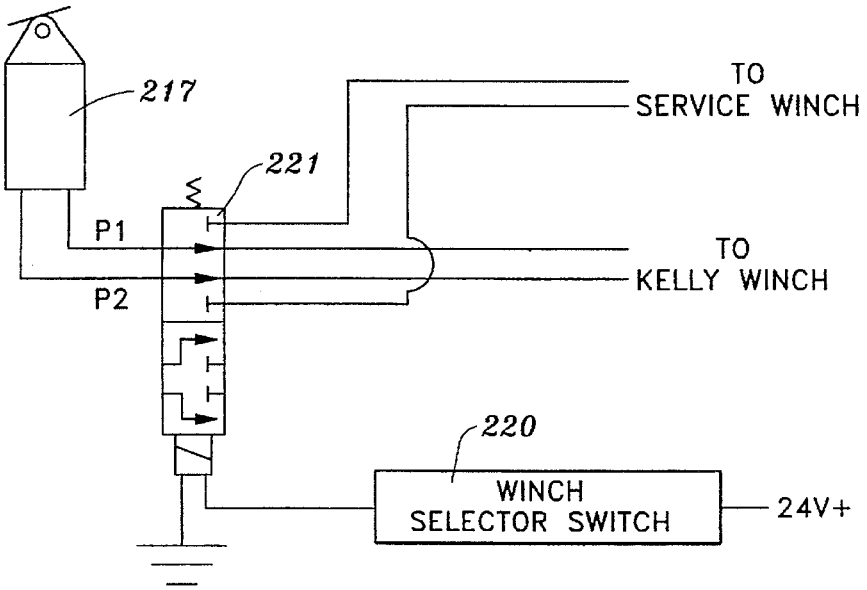
FIG. 16 is a schematic diagram of the winch selector subsystem of the winch management system of the first preferred embodiment of the present invention.

The winches 76, 78 are controlled by a foot controller or foot control pedal 217 (FIGS. 13A and 16) which is mounted on the floor 18.1 of cab 18 (FIG. 1).

The excavator stick control, which is found in the unmodified Model 225 Excavator, is now the fore-and-aft tilt control, and the bucket control of the unmodified Model 225 Excavator is now the side tilt control.

Put differently, the control handle/control valve subsystem which operated the bucket of the unmodified Model 225 Excavator now controls the side tilt of augering apparatus 10, and the control handle/control valve subsystem which operates the stick of the unmodified Model 225 Excavator now controls the fore-and-aft tilt of augering apparatus 10.

Referring now to FIG. 11, there is shown a logic diagram representing the modes of operation of the winch management system (WMS) 200 of the present invention.

FIG. 12 is a tabular key to the input and output signals received and emitted by the winch management system 200 of the present invention as shown in FIG. 11.

It is to be understood that the logic diagram of FIG. 11 is only schematically representative of the operation of winch management system 200, and that there is no necessary correspondence between the gates, etc., shown in FIG. 11 and particular electrical or hydraulic components of the winch management system 200, which is a part of the power and control system (PCS) of the first preferred embodiment of the present invention.

As seen in FIG. 11, the operations of winch management system 200 are represented by three AND gates 302, 304, 306, and an inverter 308 which changes the signal received at input terminal E (310) of the logic network 300 shown in FIG. 11 to the complement thereof, which complement is applied to input terminal 312 of gate 302.

As may be seen by comparison of FIGS. 11 and 12, the signal received at input terminal A of logic network 300 is the KCS or kelly cable slack signal, derived from switch 77 shown in FIG. 6, which assumes its logical one or significant value whenever kelly cable 80 is slack (FIG. 6).

Figure 14:
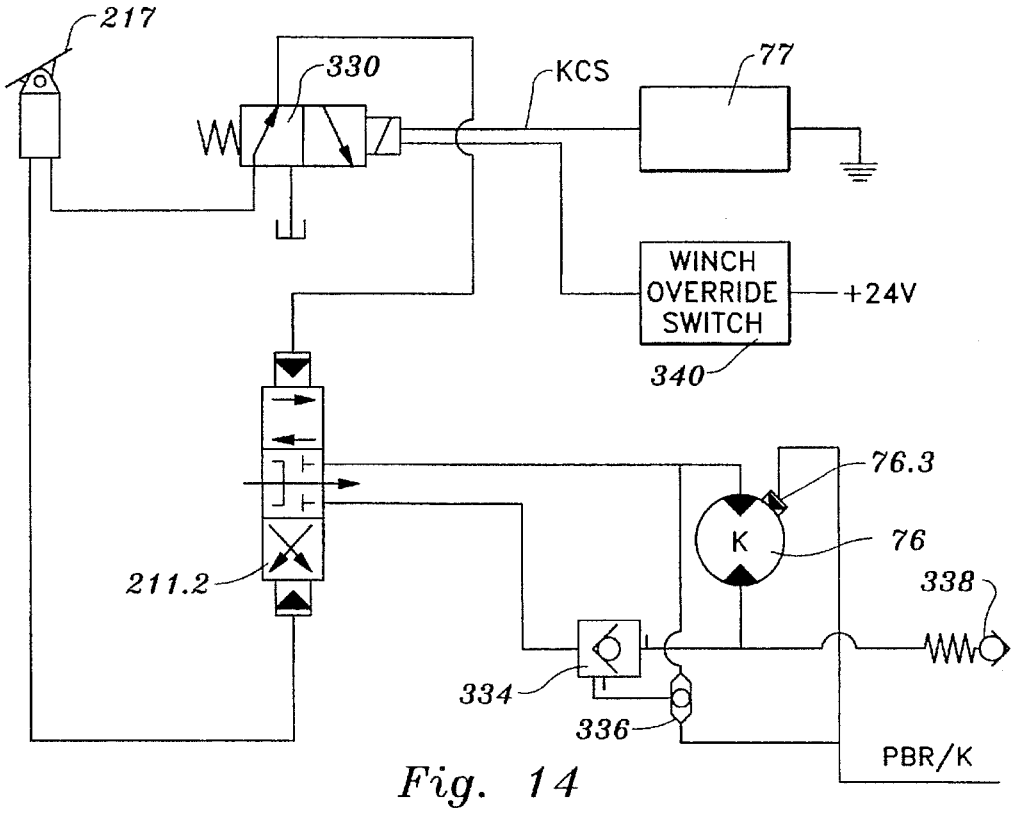
FIG. 14 is a schematic diagram of the bottomhole kelly cable arrestment subsystem of the winch management system of the first preferred embodiment of the present invention.

As may also be seen by comparison of FIGS. 11 and 12, the signal received at input terminal E of network 300 is the OOA signal, which is derived from switch 340, shown in FIG. 14.

As may further be seen by comparison of FIGS. 11 and 12 the signal produced at output terminal 1 of logic network 300 is the SKW or stop kelly winch signal.

This operation of winch management system 200 will sometimes be referred to herein as the "bottom hole kelly cable arrest function".

Again comparing FIGS. 11 and 12, it will be seen that the two input terminals of gate 304 receive respectively, the SCST signal and a KTR or "kelly tube being raised" signal.

As also seen in FIGS. 11 and 12, the output signal of gate 304, which occurs whenever the SCST signal is applied to input terminal B and the KTR signal is applied to input terminal C, is the PBR/S or service winch partial brake release signal described hereinabove.

Thus, it will be understood that whenever service cable 85 is stored and kelly tube 84 is being raised, winch management system 200 functions to bring about the partial release of service winch brake 78.2 (FIG. 2).

As also seen in FIGS. 11 and 12, the KTR signal and the PBR/K signal are identical, and thus whenever kelly tube 84 being raised, kelly winch brake 76.2 is partially released.

As also seen in FIGS. 11 and 12, the input terminals of gate 306 receive, respectively, the SCST signal and the KTL or "kelly tube being lowered" signal, and the output signal of gate 306 is the RI/S or "reel in service cable" signal.

Thus, it will be understood that whenever service cable 85 is stored and kelly tube 84 is being lowered winch management system 200 functions to take in or reel in service cable 85 (FIG. 2).

As also seen in FIGS. 11 and 12, the KTL or "kelly tube is being lowered" signal is identical to the RI/K or "reel in kelly cable" signal, and thus whenever kelly tube 84 is being lowered, kelly cable 84 is being reeled in.

Referring now to FIG. 14, there is shown a schematic representation of the bottomhole kelly cable arrestment subsystem (BKCA) of the present invention.

As seen in FIG. 14, the kelly cable slack (KCS) signal, derived from switch 77 (FIGS. 5 and 6), operates solenoid-operated valve 330, and thus serves to disconnect foot control 217 (FIG. 13A) from section 211.2 of valve 211 when kelly cable 80 becomes slack (FIG. 6), e.g., when auger 31 is descending into a hole after a spin-off operation and contacts the bottom of the hole.

Thus, it will be understood by those having ordinary skill in the art, informed by the present disclosure, that when kelly cable 80 becomes slack due to auger 31 contacting the bottom of a partially drilled hole, foot control 217 is prevented from further paying out kelly cable 80 until the opening of switch 77, as by the advancing of auger 31 into the ground.

As further seen in FIG. 14, manually operated winch override switch 340 is connected in series with switch 77 and the coil of solenoid-operated switch 330 between the 24-volt source of electrical supply and ground.

Thus, it will be seen by those having ordinary skill in the art, informed by the present disclosure, that manual operation of winch override switch 340 (which is accessible to the operator—FIGS. 13A and 13B) enables the operator to immediately overcome the effect of kelly cable slack (KCS) switch 77, and thus to immediately restore the control of foot control 217 over kelly winch 76.

Figure 15:
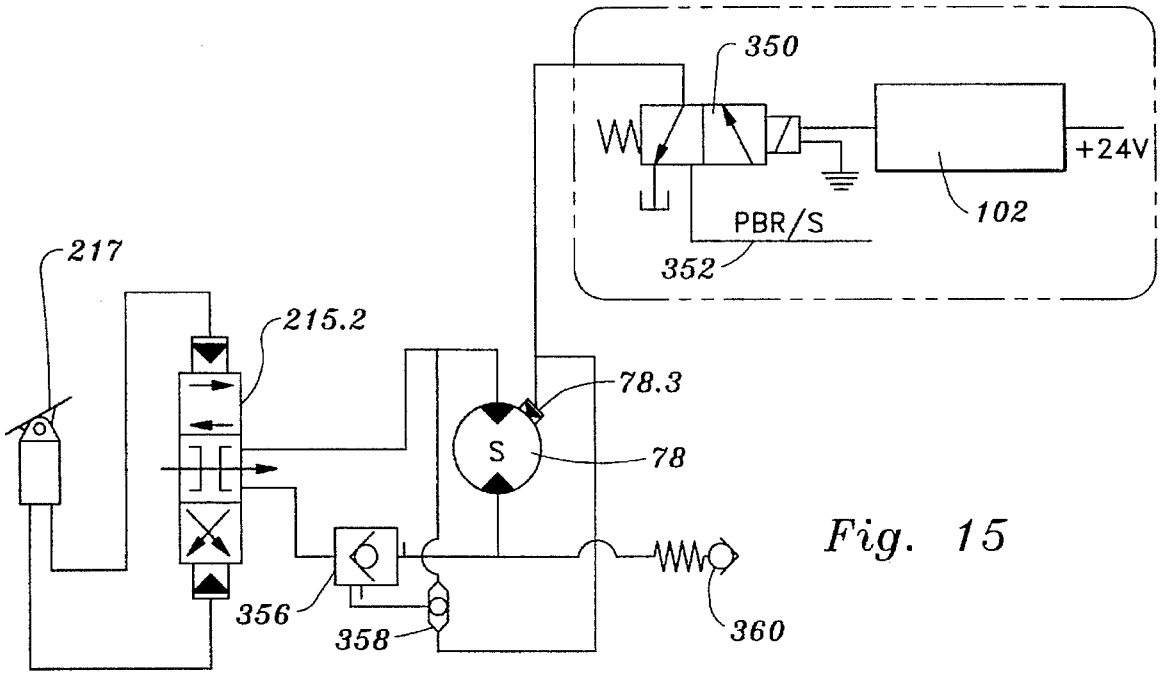
FIG. 15 is a schematic diagram of the service cable monitoring subsystem of the winch management system of the first preferred embodiment of the present invention.

Referring now to FIG. 15, there is shown the service cable monitoring subsystem of the winch management system of the first preferred embodiment of the present invention.

As shown and described hereinabove, switch 102 (FIGS. 3 and 4) is closed when service cable 85 is stored (FIG. 4). As seen in FIG. 15, switch 102 controls the operation of a solenoid-operated valve 350.

When solenoid-operated valve 350 is deenergized (service cable 85 deployed and switch 102 open), external brake release port 78.3 is drained to the system sump, and thus the operation of the drum of service cable winch 78 is directly controlled by foot control 217.

When, however, service cable 85 is stored (FIG. 4), and consequently switch 102 is closed, external brake release port 78.3 is connected via solenoid operated valve 350 to partial brake release line 352, the fluid pressure in which, being thus conveyed to external brake release port 78.3, brings about the partial applying of the brake of service winch 78, which, as explained, above, allows cable to be pulled off the drum of service winch 78 in response to upward movement of tube 84 (FIG. 1).

It will thus be seen that the objects set forth above, among those made apparent from the preceding description, are efficiently attained, and since certain changes may be made in the above constructions and the method carried out thereby without departing from the scope of the present invention, it is intended that all matter contained in the above description or shown in the accompanying drawings shall be interpreted as illustrative only, and not in a limiting sense.

It is also to be understood that the following claims are intended to cover all of the generic and specific features of the invention hereindescribed, and all statements of the scope of the invention which, as a matter of language, might be said to fall therebetween.

What is claimed is:

1. Downcrowdable telescopic augering apparatus, comprising:

a vehicle having a power-operated boom which has a distal end remote from said vehicle;

an auger mounted on said distal end of said boom; and a power and control system comprised of a vehicle power and control system mounted on said vehicle and an auger power and control system mounted on said auger;

said vehicle being provided with internal combustion engine means, electrical power source means, and hydraulic pump means for supplying electrical power and hydraulic fluid under pressure to said power and control system;

said auger comprising a cradle pivotably mounted on said distal end of said boom, a kelly tube slidably mounted in said cradle, a kelly assembly telescopingly mounted in said kelly tube, a kelly winch mounted on said cradle and including a drum, a brake for controlling the operation of said drum, and a kelly cable wound on said drum, and a service winch mounted on said cradle and including a drum, a brake for controlling the operation of said drum, and a service cable wound on said drum, whereby to raise a load attached to said service cable;

wherein said power and control system includes a winch management system for automatically operating said winches to prevent said cables from being broken or becoming slack when said kelly tube is moved with respect to said cradle; and wherein said winch management system includes service cable stored signal producing means including an arm adapted to be attached to the end of said service cable remote from said service winch and a switch operated by said arm to produce a signal when said service cable is attached to said arm and is taut.

2. Downcrowdable telescopic augering apparatus as claimed in claim 1 wherein said winch management system includes a partial service winch brake release system for releasing said brake of said service winch sufficiently to permit cable to be pulled off said drum of said service winch without losing control of said load on said service cable.

3. Downcrowdable telescopic augering apparatus as claimed in claim 2 wherein said winch management system includes a partial kelly winch release system for releasing said brake of said kelly winch sufficiently to permit cable to be pulled off said drum of said kelly winch without losing control of said load on said kelly cable.

4. Downcrowdable telescopic augering apparatus as claimed in claim 3 wherein said winch management system includes a kelly cable slack takeup system adapted to supply supplemental pressurized fluid to a drive motor adapted to drive said kelly winch, whereby to take up slack in said kelly cable without affecting the operation of said kelly assembly.

* * * * *